United States Patent [19]

Maxey

[11] 4,056,328

[45] Nov. 1, 1977

[54] SNOW GROOMER FOR SNOWMOBILE TRAILS

[76] Inventor: Loren R. Maxey, 615 S. Loomis, Fort Collins, Colo. 80521

[21] Appl. No.: 769,733

[22] Filed: Feb. 17, 1977

[51] Int. Cl.[2] ..... E01C 19/41

[52] U.S. Cl. ..... 404/96; 404/122; 37/10; 37/46; 172/787

[58] Field of Search ..... 404/92, 101, 122, 124, 404/106, 96; 172/779, 787; 37/10, 12, 13

[56] References Cited

U.S. PATENT DOCUMENTS

| | | | |
|---|---|---|---|
| 1,103,929 | 7/1914 | Beer | 404/128 X |
| 1,995,267 | 3/1935 | Pease | 404/101 |
| 2,116,468 | 5/1938 | Cost | 404/92 |
| 2,142,262 | 1/1939 | Beckham | 404/96 |
| 2,154,720 | 4/1939 | Biles | 404/122 X |
| 2,184,913 | 12/1939 | Fuller | 404/96 |
| 2,925,870 | 2/1960 | Michelsen | 404/122 X |
| 3,371,586 | 3/1968 | Nikolaev | 37/10 X |
| 3,755,930 | 9/1973 | Brandt | 37/10 |
| 3,829,991 | 8/1974 | Cheney | 404/96 X |

*Primary Examiner*—Nile C. Byers
*Attorney, Agent, or Firm*—Hugh H. Drake; Ralph F. Crandell

[57] ABSTRACT

An apparatus for grooming snowmobile trails is towed by a dirigible tracked vehicle and includes a generally horizontal main frame, a gooseneck hitch supporting the forward end of the frame in towing engagement with the tracked vehicle, a packing roller supporting the rear end of the frame which serves to pack the snow being groomed, a moldboard scraper mounted between the packing roller and the gooseneck hitch which serves to scrape and level the snow being groomed, and a cutting blade assembly mounted forwardly of the moldboard scraper cuts, breaks and moves snow to fill in grooves and level ridges. A floating pan secured to the rear end of the main frame smoothes the snow following packing by the roller. The snow breaking and cutting blade assembly includes a pair of opposed, spaced-apart cutting blades pivotally secured to the frame and inclined inwardly and rearwardly, and a central V-shaped cutting blade pivotally secured to the frame with the apex thereof directed forwardly. The inner free ends of the inclined blades and the apex of the V-shaped blade are coordinated for raising and lowering to cause the apex of the V-shaped blade to swing oppositely to the free ends of the inclined blades for purposes of controlling the flow of snow through the frame to the moldboard scraper and packing roller.

5 Claims, 6 Drawing Figures

SNOW GROOMER FOR SNOWMOBILE TRAILS

The present invention relates to trail grooming equipment finding particular but not necessarily exclusive utility for grooming the snow on snowmobile trails.

It is the principal object of the present invention to provide an improved snowmobile trail grooming apparatus which is adapted to be pulled by a dirigible tracked vehicle and which effectively and efficiently levels and smooths tracks and trails for subsequent use by snowmobiles for recreational and racing purposes.

More specifically, it is an object of the present invention to provide an improved apparatus for leveling, packing and smoothing snowmobile trails.

Other objects and advantages of the present invention will become apparent as the following description proceeds taken in conjunction with the accompanying drawings.

SUMMARY OF THE INVENTION

In accordance with the foregoing objects, there is provided an improved apparatus for grooming the snow on snowmobile trails. The apparatus is adapted to be towed by a dirigible tracked vehicle and is formed by a generally horizontal main frame supported by a gooseneck hitch secured in towing engagement with the tracked vehicle. For raising and lowering the forward end of the main frame, the gooseneck hitch is adapted to be raised and lowered with respect to the towing vehicle. At the rear end of the main frame, there is provided a packing roller mounted transversely within and supporting the rear end of the frame. The packing roller serves to compact the snow surface being groomed. The frame is adjustable relative to the packing roller so that the rear end of the frame can be raised and lowered with respect to the snow surface.

For purposes of scraping and leveling the snow, a moldboard scraper is positioned between the packing roller and the gooseneck hitch. The position of the moldboard scraper is adjustable in order to adjust the depth of cut as well as the amount of snow being scraped from one spot and dumped in another.

For cutting the snow surface being groomed to reduce the height of ridges and fill in ditches or channels formed by snowmobiles, a unique and novel cutting blade assembly is provided. This assembly is supported by the main frame in front of the moldboard scraper and serves to break the snow surface, stir and mix the snow, and channel the snow in the desired flow pattern through the grooming unit to the moldboard leveling scraper and the packing roller.

The cutting blade assembly is formed by a pair of opposed, spaced-apart inwardly and rearwardly inclined cutting blades pivotally secured at one end to the forward end of the main frame and extending at a rearwardly inclined angle toward the center of the main frame. The inner free ends of the cutting blades can be adjusted upwardly and downwardly to decrease or increase the depth of cut and thereby the amount of snow channeled towards the longitudinal center of the frame. Positioned rearwardly of the pair of inwardly inclined blades there is a V-shaped blade also pivotally mounted on the frame and with its apex directed forwardly towards the opening between the inclined side blades. The apex of the V-shaped cutting blade is adjustable upwardly and downwardly to decrease or increase the depth of cut and thereby the amount of snow channelled to flow away from the longitudinal center of the frame.

The means for raising and lowering the inner free ends of the inclined blades and the apex of the V-shaped blade are coordinated to provide for movement of the inner free ends of the inclined blades oppositely to the direction of movement of the apex of the V-shaped blade. In this manner, the flow of the snow which is broken by the cutting blade and channelled through the grooming apparatus can be controlled. The snow thus cut and flowing through the apparatus is leveled by the moldboard scraper and subsequently packed by the packing roller and smoothed by a trailing floating pan.

DESCRIPTION OF THE PREFERRED EMBODIMENT

Figure 1:
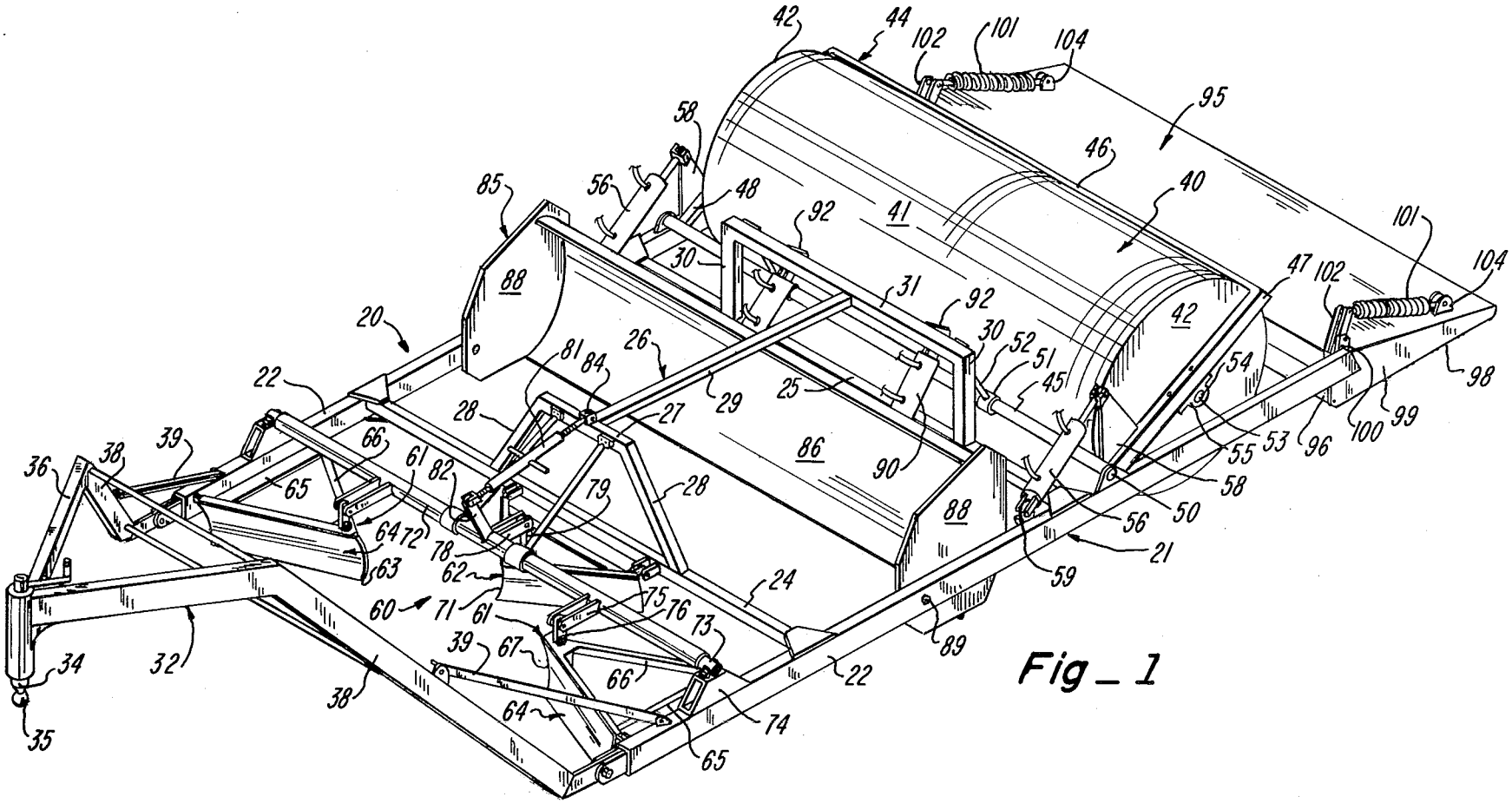
FIG. 1 is a perspective view of a snowmobile trail groomer embodying the present invention.
Figure 3:
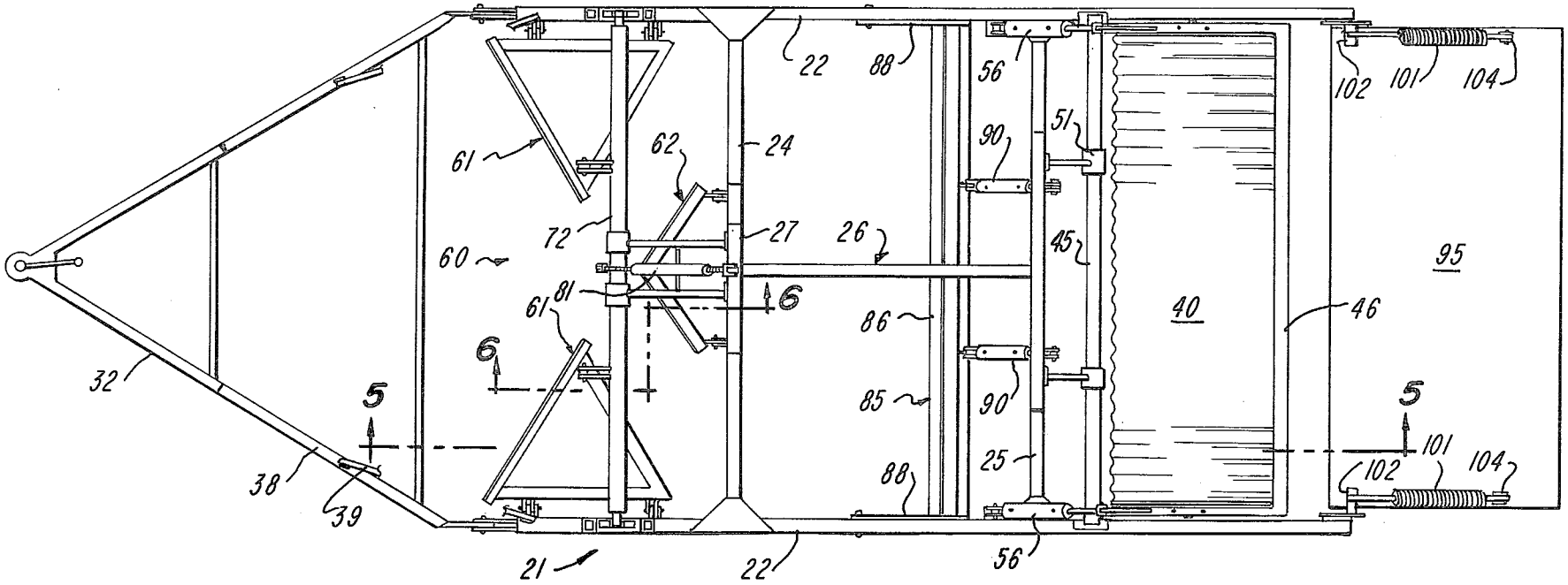
FIG. 3 is a top plan view of the snowmobile trail groomer shown in FIG. 1.
Figure 2:
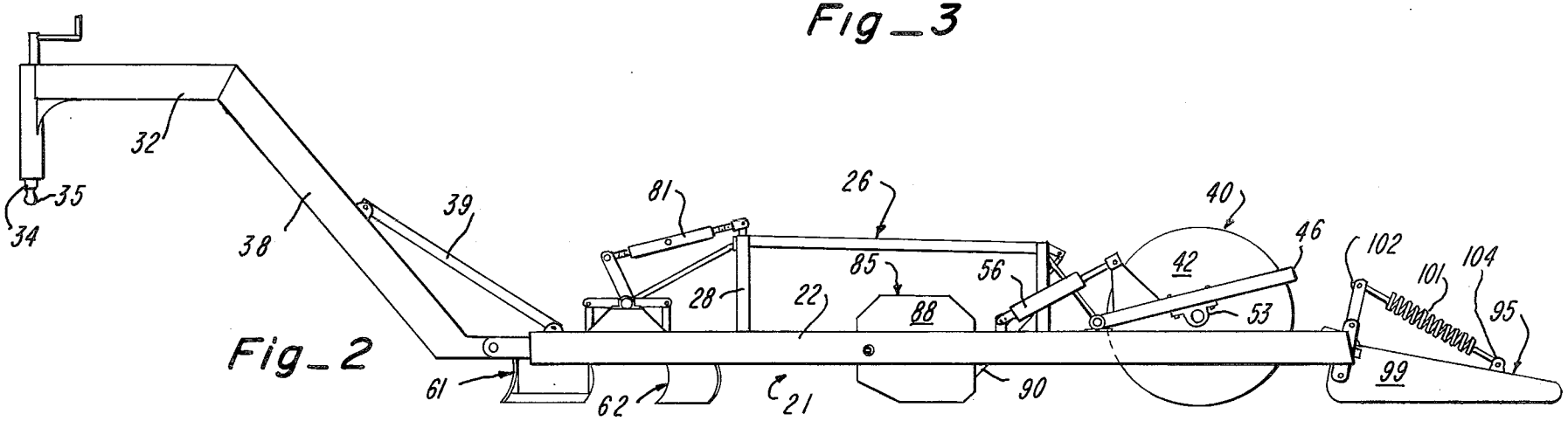
FIG. 2 is a side elevation view of the snowmobile trail groomer shown in FIG. 1.

The snowmobile trail groomer embodying the present invention provides an efficient and effective mechanism for grooming the surfaces of snowmobile trails for recreational or racing use. To this end, the trail groomer is adapted to be secured to and towed by a dirigible tracked vehicle capable of operating over a variety of snow conditions and depths. Illustrative tracked vehicles suitable for this purpose are the Tucker "Sno-Cat," Thiokol, and the Bombardier "Skidozer." The snowmobile trail groomer embodying the present invention, when towed behind a dirigible tracked vehicle, cuts and breaks up the snow and provides a complete and thorough grooming action to channel more or less snow towards the center of the unit. The snow surface is then leveled by a moldboard blade unit, followed by a packing roller which compacts the cut and leveled snow surface. The unit further trails a floating pan which smooths out the surface to provide the best possible grooming for snowmobile trails. The groomer produces a trail suitable for both recreational and racing use, eliminates mogules and bumps, and levels and fills in ridges and track grooves. The unit can move snow from high spots in the trail to low spots, and leaves a smooth, compacted surface for safe snowmobile riding.

The snowmobile trail groomer 20 as shown in the drawings is constructed on a generally rectangular main frame 21 formed by a pair of spaced, parallel side beams 22 joined intermediate their ends by spaced transverse front and rear cross beams 24, 25 respectively. A generally H-shaped superstructure 26 is positioned between the side beams 22 above the transverse cross beams 24, 25 and is formed at its front portion by two downwardly sloping front legs 28 secured at their lower ends to the cross beam 24 and with their upper ends joined on a short horizontal beam 27 secured at the front end of a longitudinally extending ridge beam 29. The rear portion of the H-shaped superstructure 26 is formed by a pair of downwardly extending legs 30 joined by a transverse upper beam 31 secured at its mid-point to the rear end of the longitudinal ridge beam 29.

For supporting the frame 21 for towing by a dirigible tracked vehicle (not shown), the forward end of the frame 21 is secured to a gooseneck hitch 32 adapted for towing engagement with the tracked vehicle. For adjusting the height of the gooseneck hitch 32 with respect to the towing vehicle, and thereby adjusting the height of the forward end of the main frame 21 with respect to the surface being groomed, the gooseneck hitch 32 is provided with a depending crank-adjustable mounting post 34 at its forward end. The post 34 carries a conventional ball-type hitch member 35 for engagement in a mating socket (not shown) on the towing vehicle. The gooseneck includes an upper generally horizontal rigid triangular frame 36 supporting the depending adjustable post 34 at its apex and, at the opposite side or base, carrying outwardly and downwardly sloping legs 38 adapted to be secured at their lower ends to the forward end of the main frame side beams 22. The gooseneck is rigidly braced to the side frames by inclined brace members 39 to provide a rigid support for the forward end of the main frame 21.

The rear end of the main frame 21 is carried on and supported by a packing roller 40 formed by a cylindrical corrugated roller member 41 closed at each end by wheel flanges 42. The packing roller 40 is supported in a generally rectangular frame 44 pivotally mounted on the main frame 21 adjacent the rear end thereof. The packing roller frame 44 supports the packing roller in a position transversely of the main frame 21 and for vertical swinging movement with respect thereto, so that the rear end of the main frame 21 can be raised and lowered relative to the snow surface being groomed. To this end, the packing roller frame 44 is formed by spaced parallel transverse frame members 45, 46 joined at their ends by parallel end frame members 47, 48. The forward transverse frame member 45 defines a torsion or hinge bar which is supported at its ends in bearings 50 mounted on the upper edges of the main frame side beams 22. Further support is given to the torsion bar frame member 45 by inboard supports constituting journal bearings 51 journaling the torsion bar 45 and supported on the ends of braces 52 secured to and depending from the upper rear H-frame cross member 31. The packing roller 46 includes axel members 53, the ends of which are journaled for rotation in bearings 54 held in depending bearing brackets 55 secured to the underside of the end frame members 47, 48 of the packing roller frame 44.

For raising and lowering the main frame 21 with respect to the packing roller 40, and thereby with respect to the snow surface on which the packing roller 40 rides, a pair of hydraulic piston and cylinder motors 56 act between an upstanding bracket 58 on each of the roller frame end members 47, 48 and upstanding brackets 59 on the main frame side beams 22. Actuation of the hydraulic motors 56 serves to swing the packing roller frame 44 about the pivot axis of the torsion member 45 thereby to effectively raise or lower the rear end of the main frame 21 with respect to the axis of rotation of the packing roller 40 and thereby with respect to the snow surface on which the packing roller 40 rides.

The packing roller 40 is of conventional construction and defines a generally corrugated surface. To add weight, it may be filled with any appropriate material which is of sufficient density to provide the compacting pressure desired. Alternatively, reliance can be placed on the weight of the packing roller itself which is generally made of a heavy steel sheet meterial.

As can be seen from the foregoing construction, the main frame 21 is supported at its front end by the gooseneck hitch 32 and at its rear end by the packing roller 40. The height of the main frame 21 above the snow level is adjusted at the front by adjusting the height of the gooseneck relative to the towing vehicle and is adjusted at its rear end by adjusting the frame 21 relative to the packing roller 40.

Figure 4:
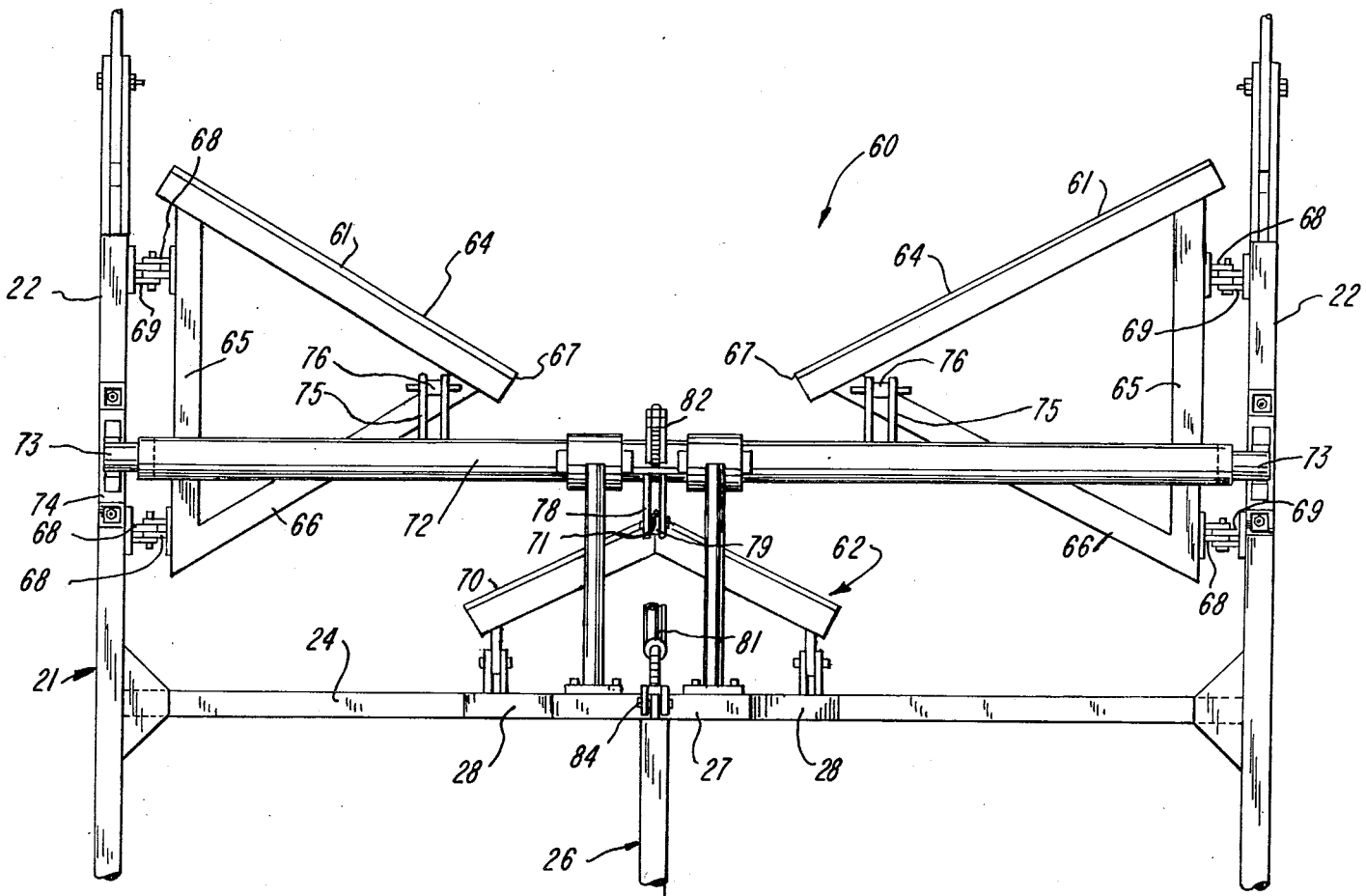
FIG. 4 is an enlarged top plan view of a portion of the snowmobile trail groomer shown in FIG. 3 and illustrating specifically the snow cutting and breaking portion of the snowmobile trail groomer.
Figure 5:
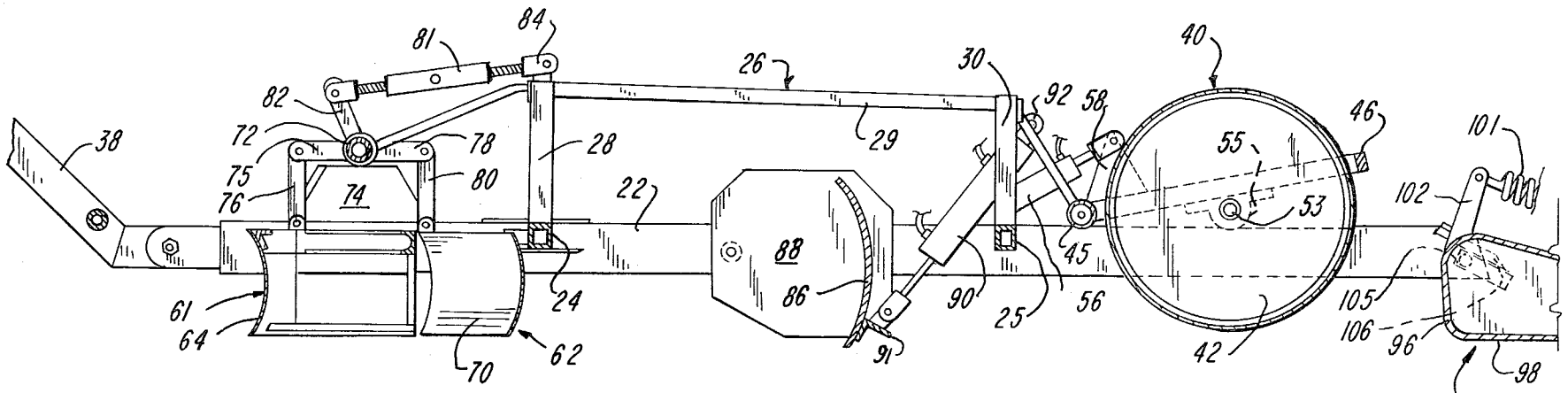
FIG. 5 is a section view taken substantially in the plan of line 5—5 on FIG. 3.
Figure 6:
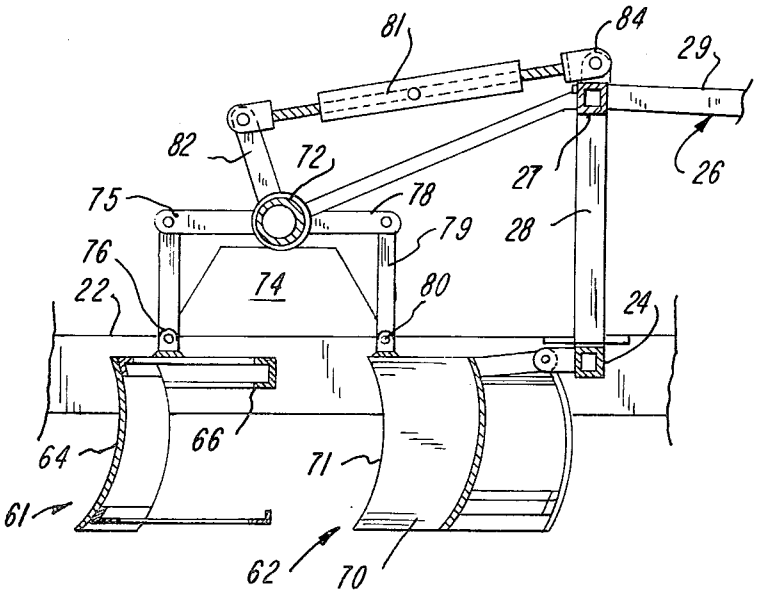
FIG. 6 is a section view taken substantially in the plan of line 6—6 on FIG. 3.

In the grooming of snowmobile trails, it is important to break up the snow in order to cut down ridges which have been created by the passage of snowmobile traffic, as well as to fill in grooves formed by the snowmobiles. Snowmobiles also create mogules or transverse bumps across the trail which gradually become higher with resulting deeper trenches as trail use increases. For this purpose the trail groomer 20 embodies a cutting blade assembly 60 (FIG. 4) for cutting and breaking the snow along the trail and for channeling the snow either towards the longitudinal center of the grooming apparatus or more towards the outer edges thereof as defined by the main side beams 22. In this manner, a central ridge can be trimmed down and the snow channeled to either side to either fill in tracks, or a single track can be filled in by channeling snow from the ridges on either side.

In order to cut, break and channel the snow along the trail being groomed, the snow cutting and breaking mechanism 60 is embodied in the present invention is formed by a pair of spaced, rearwardly inclined blade structure assemblies 61 and a central, forwardly directed V-shaped blade structure assembly 62. For purposes of controlling the snow cutting and directing action of the side blades 61 and V-blade 62, the inner ends of the side blades 61 and the apex of the V-blades 62 are adapted to be raised and lowered relative to the snow surface being groomed. By controlling the height of these elements above the snow surface, the snow can be broken and cut and channelled in the desired direction.

The straight or forward inclined blade sections 61 each comprise a cutting blade 64 supported by a generally triangular blade mounting bracket structure composed of two legs 65, 66 joined together at one end to form an apex and secured at their ends opposite from the apex to the rear side of the blade 64. One of the support legs 65 is pivotally mounted onto the adjacent main frame side beam 22. For this purpose, the mounting leg 65 is provided with two sets of apertured ears 68 pivotally secured to mating pairs of apertured ears 69 projecting inwardly from the adjacent main side beam 22. In this manner, the inner ends 67 of the blades 64 can be swung upwardly or downwardly relative to the main frame 21. The blade 64 is further positioned at an inwardly and rearwardly inclined angle with respect to the main frame side beam 22 on which it is mounted thereby to channel snow cut from the trail being groomed towards the central longitudinal axis of the grooming apparatus main frame 21. By lowering the innermost ends 67 of the blades 64, a deeper cut can be made in that portion of the snow. The blades 64 are of a length extending partially but not completely on the longitudinal center of the apparatus main frame 21, thereby leaving an opening between the two blades 64 mounted on the side beam 22 of the frame 21.

For cutting and channelling snow away from the central longitudinal axis of the groomer 20 there is positioned centrally of the opening between the blades 64 and rearwardly therefrom the V-shaped cutting blade assembly 62. The V-shaped blade assembly 62 is provided by a generally V-shaped cutting blade 70 having its apex 71 directed generally forwardly and defining blade faces sloping outwardly and rearwardly. With this configuration, the assembly 62 serves to channel snow from the central portion of the main frame 21 towards the outer side extremeties bounded by the side beams 22.

For purposes of controlling the amount of snow directed longitudinally centrally as compared to the amount of snow directed outwardly, the inner ends 67 of the outer blades 64 and the apex 71 of the V-shaped blade 70 are adapted to be moved and positioned vertically in opposition to one another. In other words, as the inner ends 67 of the blades 64 of the outer blade assembly 61 are moved downwardly for purposes of directing a greater amount of snow towards the central longitudinal axis of the frame, the apex 71 of the V-blade 70 of the V-blade assembly 62 is raised in order to allow a greater amount of snow to remain in the central portion of the grooming apparatus with a lesser amount of snow being directed outwardly. Conversely, if it is desired to direct a greater amount of snow outwardly away from the central portion of the grooming apparatus 20, the apex 71 of the V-shaped blade 70 is lowered to take a deeper cut while simultaneously the inner ends 67 of the outer blades 64 are raised to take a lesser cut. In this manner, a greater amount of snow will be removed from the central longitudinal portion of the grooming frame and directed outwardly towards the outer side extremeties. With this blade configuration, a central ridge can be readily removed by lowering the apex 71 of the V-shaped blade 70 and simultaneously raising the inner ends 67 of the outer blades 64. Conversely, a central groove or track can be filled by raising the apex 71 of the V-shaped blade 70 and simultaneously lowering the inner ends of the inclined blades 64.

To accomplish the coordinated raising and lowering movement of the respective blades, there is provided a torsion bar 72 extending generally transversely of the frame 21 and journaled at its opposite ends in bearings 73 supported on bearing brackets 74 mounted on the upper edges of the main side beams 22. Forwardly extending arms 75 on the torsion bar 72 engage depending links 76 articulated with upstanding brackets on the triangular braces supporting each blade 64. Similarly, a rearwardly extending arm 78 is pivotally articulated with a depending link 79 pivotally secured between spaced upstanding apertured ears 80 on the V-blade assembly 62 adjacent the apex of the V-shaped blade 68. The torsion bar 72 is rotated by an appropriate motor assembly 81 such as a jackscrew or hydraulic piston and cylinder mounted between an upstanding leg 82 on the torsion bar 72 and an apertured bracket 84 secured to the forward portion of the H-shaped superstructure 26. By rotating the torsion bar 72 in one direction or the other through the action of the motor 81, the respective ends of the blades 64 and 70 are respectively raised or lowered.

For purposes of scraping the snow and leveling the trail to cut down mogules and fill any transverse depressions, there is provided an adjustable moldboard scraper 85 positioned in the main frame 21 intermediate the forward cutting blades assembly 60 and the rear packing roller 40. The moldboard leveling scraper 85 is formed by a concavely curved blade 86 extending generally transversely of the main frame 21 between the side beams 22 and supported at either end by spaced vertical end wall panels 88. The end wall panels are pivotally engaged by appropriate pivot pin mountings 89 to the side beams 22. For adjusting the tilt of the moldboard blade 86, there is provided a pair of hydraulic motors 90 extending between brackets 91 on the lower edge of the blade 86 and corresponding brackets 92 on the rear crossbeam 31 of the H-frame superstructure. The moldboard blade 86 can be tilted to take a deeper or shallower cut depending upon the amount of snow to be scraped from a mogule or mound and moved for dumping in a lower spot.

The loose or broken snow kicked up by the cutter blade assembly 60 is collected in the desired amounts in the moldboard section thereby creating a leveling action on the snow trail. The loose snow which has been cut and leveled is then packed by the trailing pack roller 40. Finally, there is provided a floating pan 95 which smoothes out the surface to provide the best grooming possible for snowmobile trails.

In order to provide the final smoothing to the snow surface, the floating pan 95 is generally tear-drop in shape, being formed by a leading edge tubular member 96 with a bottom leveling panel 98 supported between tear-drop shaped side panels 99. The floating pan is pivotally mounted between brackets 100 extending rearwardly from the side beams 22 of the main frame 21, and rides on the snow surface.

To add additional compaction and smoothing force, a pair of compression springs 101 are provided acting between upstanding brckets 102 on the main frame side beams 22, and apertured brackets 104 adjacent the trailing edge of the floating pan 95. The pivotal mounting of the floating pan allows the trailing edge to be lifted by obstructions, but the pan is prevented from dropping below the horizontal by stops 105 on the brackets 100 which engage projections or abutments 106 on the tear-drop end panels 99.

It will be appreciated from the foregoing description that the grooming apparatus embodying the present invention provides a thorough and effective grooming action by cutting and filling ridges and troughs as well as scraping mogules and filling transverse ditches followed by a thorough packing and smoothing operation. The unit is easily pulled by a dirigible tracked vehicle. The unit is readily adjustable and provides efficient and effective snow grooming under a wide variety of snow conditions.

While a certain illustrative embodiment has been shown in the drawings and described in considerable detail, it should be understood that there is no intention to limit the invention to the specific form disclosed. On the contrary, the invention is to cover all modifications, alternative constructions, equivalents and uses falling within the spirit and scope of the invention as expressed in the appended claims.

What is claimed is:

1. Apparatus adapted to be towed by a dirigible tracked vehicle for grooming snow on snowmobile trails, said apparatus comprising, in combination:

a generally horizontal main frame;

a hitch supporting the forward end of said frame adapted for towing engagement with the tracked vehicle;

means on said hitch for raising and lowering the same relative to the vehicle thereby to raise or lower the forward end of said main frame relative to the snow surface being groomed;

a packing roller mounted transversely within and supporting the rear end of said frame and for compacting the snow surface being groomed;

means for adjusting the position of said main frame relative to the packing roller, thereby to raise and lower the rear end of said main frame relative to the snow surface being groomed;

a moldboard scraper mounted transversely within said main frame in front of said packing roller for scraping and leveling the snow surface being groomed;

means adjustably mounting said moldboard scraper on said frame for raising and lowering said moldboard relative to the snow surface being groomed;

cutting blades mounted within the forward end of said frame for cutting and moving snow toward the longitudinal center axially of said frame;

means adjustably mounting said cutting blades on said main frame for varying the position and cutting depth of said blades reltive to said main frame;

and a floating pan secured to the rear of said main frame for smoothing the snow surface which has been cut by said cutting blades, leveled by said molboard and compacted by said packing roller thereby to provide a smoothed and leveled snow trail for snowmobiles.

2. Apparatus as defined in claim 1 wherein said cutting blades comprise, in combination:

a pair of opposed spaced-apart cutting blades pivotally secured at one end to the forward end of the main frame and extending at a rearwardly inclined angle toward the center of the main frame for cutting and directing snow towards the central longitudinal axis of the frame;

means for swinging the blades to raise or lower their free ends relative to the snow surface thereby to position said blades to take a shallower or deeper cut;

a central V-shaped cutting blade pivotally mounted at its base on the main frame and with its apex directed forwardly for cutting and directing snow away from the central longitudinal axis of the frame;

means for vertically swinging the V-shaped blade to raise and lower the apex relative to the snow surface thereby to cause said blade to take a shallower or deeper cut;

both of said swinging means being coordinated to cause the apex of the V-blade to swing oppositely to the free ends of the inclined blades thereby to control the quantity of snow directed centrally of the frame by the cutting blades.

3. A cutting blade assembly for use in an apparatus adapted to be towed by a dirigible tracked vehicle for grooming snow on snowmobile trails, which apparatus includes a generally horizontal main frame, a height adjustable gooseneck hitch supporting the forward end of said frame and adapted for towing engagement with the tracked vehicle, a packing roller mounted transversely within and supporting the rear end of said frame, and a moldboard scraper mounted on said main frame intermediate said gooseneck hitch and said packing roller, said cutting blade assembly comprising, in combination:

a pair of opposed spaced-apart cutting blades pivotally secured at one end to the forward end of the main frame and extending at a rearwardly inclined angle toward the center of the main frame and said moldboard scraper for cutting and directing snow towards the central longitudinal axis of the frame;

means for swinging said inclined blades to raise or lower their free ends vertically relative to the snow surface being cut thereby to adjust said blades to make a shallower or deeper cut;

a central V-shaped cutting blade pivotally mounted at its base on the main frame and with its apex directed forwardly for cutting and directing snow away from the central longitudinal axis of the frame;

means for swinging the V-shaped blade to raise and lower the apex thereof vertically relative to the snow surface thereby to cause said blade to take a shallower or deeper cut;

both of said swinging means being coordinated to cause the apex of the V-shaped blade to swing oppositely to the free ends of the inclined blades whereby to control the quantity and flow of snow directed through the frame by the cutting blades.

4. A cutting blade assembly for use in an apparatus adapted to be towed by a dirigible tracked vehicle for grooming snow on snowmobile trails, which apparatus includes a generally horizontal main frame, a height adjustable gooseneck hitch supporting the forward end of said frame and adapted for towing engagement with said tracked vehicle, a packing roller mounted transversely within and supporting the rear end of said frame, and a moldboard scraper mounted on said main frame intermediate said gooseneck hitch and said packing roller, said cutting blade assembly comprising, in combination:

a pair of opposed spaced-apart inclined cutting blades pivotally secured at one end to the forward end of the main frame and extending at a rearwardly inclined angle toward the center of the main frame and said moldboard scraper for cutting and directing snow towards the central longitudinal axis of the frame;

a central V-shaped cutting blade pivotally mounted at its base on the main frame and with its apex directed forwardly for cutting and directing snow away from the central longitudinal axis of the frame; and directed forwardly for cutting and directing snow away from the central longitudinal axis of the frame; and means for swinging said inclined blades and said V-shaped cutting blade to raise or lower their free ends and apex respectively thereby to adjust said blades to make a shallower or deeper cut, said means being coordinated to cause the apex of the V-shaped blade to swing oppositely to the free ends of the inclined blades whereby to control the quantity and flow of snow directed through the frame by the cutting blades.

5. A cutting blade assembly as defined in claim 4 wherein said swinging means comprises a power rotatable torsion bar extending transversely of the main frame, a pair of first links articulated between said torsion bar and said inclined cutting blades, and a second link articulated between said torsion bar and said V-shaped blade, said first links being engaged with said torsion bar in diametric opposition to said second link whereby said first links are moved oppositely from said second links upon rotation of said torsion bar to coordinate said swing means.

* * * * *